US006135094A

United States Patent [19]

Okada et al.

[11] Patent Number: 6,135,094

[45] Date of Patent: Oct. 24, 2000

[54] FILTER IN FUEL INJECTION VALVE

[75] Inventors: Shigeo Okada, Yokohama; Tomoyasu Tanino, Sendai; Manabu Shoji, Iwanuma, all of Japan

[73] Assignee: Piolax Inc., Kanagawa-ken, Japan

[21] Appl. No.: 08/870,225

[22] Filed: Jun. 6, 1997

[30] Foreign Application Priority Data

Jun. 7, 1996 [JP] Japan ..... 8-168550

[51] Int. Cl.[7] ..... F02M 37/04

[52] U.S. Cl. ..... 123/470; 123/510; 137/549

[58] Field of Search ..... 123/470, 468, 123/472, 510, 469; 137/549

[56] References Cited

U.S. PATENT DOCUMENTS

| | | | |
|---|---|---|---|
| 4,478,617 | 10/1984 | Rees | 137/549 |
| 4,649,950 | 3/1987 | Bradley | 137/549 |
| 4,676,478 | 6/1987 | Kiuchi | 123/472 |
| 4,742,964 | 5/1988 | Ito | 123/470 |
| 4,951,878 | 8/1990 | Casey | 137/549 |
| 5,018,501 | 5/1991 | Watanabe | 123/472 |
| 5,232,015 | 8/1993 | Heffner | 137/549 |
| 5,263,649 | 11/1993 | Babitzka | 251/129.15 |
| 5,533,478 | 7/1996 | Robinson | 123/510 |
| 5,584,318 | 12/1996 | Brandt | 137/549 |
| 5,636,616 | 6/1997 | Okane | 137/549 |

FOREIGN PATENT DOCUMENTS

| | | | |
|---|---|---|---|
| 4139786 | 5/1993 | Germany | 123/472 |
| 6221247 | 8/1994 | Japan | 123/472 |
| 1159992 | 6/1985 | U.S.S.R. | 137/549 |

*Primary Examiner*—Carl S. Miller
*Attorney, Agent, or Firm*—Ladas & Parry

[57] ABSTRACT

A filter in a fuel channel is made of a synthetic resin material and is inserted into the fuel channel of one edge portion on the inserting side of a second fuel pipe that is inserted and connected into a first fuel pipe, thereby removing a foreign matter in a fuel. The filter is made up of an annular flange portion having an outer diameter larger than an outer diameter of the second fuel pipe, a cylinder portion having an outer diameter smaller than the outer diameter of the annular flange portion, the cylinder portion having an opening portion provided in an outer peripheral portion so as to be communicated with a channel provided in the cylinder portion, a filter net provided for the opening portion and an annular collar member which is made of a metal material and has an outer diameter larger than an inner diameter of the second fuel pipe. The annular collar member is arranged in the outer peripheral portion of the cylinder portion and is molded integratedly with the annular flange portion and the cylinder portion so as to be buried into the annular flange portion.

10 Claims, 7 Drawing Sheets

FILTER IN FUEL INJECTION VALVE

BACKGROUND OF THE INVENTION

1. Field of the Invention

The invention relates to a fuel injection valve for electrically controlling a fuel whose pressure was raised by a fuel pump and for supplying the fuel to an engine and, more particularly, to a filter which is arranged in a fuel injection valve in order to remove a foreign matter in a fuel passing in a fuel injection valve.

2. Related Background Art

The first example of a filter in a conventional fuel injection valve is shown in FIG. 13. In the following description, a rear edge A indicates an upper portion in the diagram and a front edge B indicates a lower portion. They are used for easily understand an explanation.

Reference character N denotes a fuel injection valve comprising the following component elements.

Reference numeral 30 denotes a cylindrical housing. A fuel pipe 31 made of a metal material is formed so as to be projected from the center of a rear edge 30A of the housing 30 further toward the rear edge A side. An O ring groove 31D is formed around an outer periphery 31C of the fuel pipe 31. An elastic ring R made of a rubber material is arranged in the O ring groove 31D.

On the inside of the housing 30, there are provided: a fixed core 32 which is formed integratedly with the fuel pipe 31, a coil bobbin 34 around which a coil 33 is wound and which is arranged in the outer periphery of the fixed core 32, a movable core which is movably arranged so as to face the fixed core 32, and a valve body which is moved synchronously with the movable core and opens and closes a valve hole that is opened toward a front edge 30B of the housing 30. The movable core, valve hole, and valve body are not shown. A fuel pipe 35 is formed in the fuel pipe 31 so as to be directed from a rear edge surface 31A toward the valve hole side. The fuel pipe 35 penetrates in the fuel pipe 31 and fixed core 32 and is opened inwardly of the housing 30.

A cylindrical filter 36 is arranged in the fuel pipe 35. An annular collar member 37 made of a metal material is arranged on the outer periphery on the rear edge A side of the filter 36. A channel 36C is formed in the filter 36 from a rear edge surface 36A toward a cylinder portion 36B with a bottom on the front edge B side. A slit groove 36D is formed from the channel 36C toward the outer periphery of the filter 36.

A filter net 38 is provided over the slit groove 36D. The filter 36 is inserted with a pressure into the fuel pipe 35 of the fuel pipe 31.

The fuel injection valve N having the filter 36 is sandwiched between a fuel distributing pipe D and an intake pipe (not shown) through an elastic member C. The fuel distributing pipe D has a distributing passage 39 in the longitudinal direction connected to a fuel pump and a fuel injection valve supporting hole 40 which is opened in the distributing passage 39.

The fuel pipe 31 of the fuel injection valve N is inserted into the fuel injection valve supporting hole 40 through an opening edge thereof and is sandwiched between the fuel distributing pipe D and the intake pipe. A hermetical state of a gap formed between the outer periphery 31C of the fuel pipe 31 and the fuel injection valve supporting hole 40 is held by the elastic ring R.

The fuel supplied into the distributing passage 39 of the fuel distributing pipe D by the fuel pump flows into the fuel pipe 35 of the fuel injection valve N from the fuel injection valve supporting hole 40. A foreign matter in the fuel in the fuel pipe 35 is removed by the filter net 38 of the filter 36, so that the clean fuel is supplied toward the valve hole in the fuel injection valve N.

The second example of the filter in the conventional fuel injection valve will now be described with reference to FIG. 14. A structure of the filter in the second example differs from that of FIG. 13. Only a filer 41 will now be described.

According to the filter 41, an annular flange portion 41A is formed on the rear edge A side, a cylinder portion 41C is formed from the annular flange portion 41A toward a cylinder portion 41B with a bottom on the front edge B side, and a slit groove 41D is formed in the cylinder portion 41C.

A channel 41E is formed from a rear edge surface 41F of the annular flange portion 41A toward the cylinder portion 41B with the bottom. The slit groove 41D is opened in the cylinder portion 41C so as to face the channel 41E. Further, a filter net 42 is attached over the slit groove 41D.

The cylinder portion 41C of the filter 41 is inserted with a pressure into the fuel pipe 35 of the fuel pipe 31. In this instance, the annular flange portion 41A is arranged so as to be in contact with the rear edge surface 31A of the fuel pipe 31.

According to the conventional first example, when the fuel pipe 31 of the fuel injection valve N is inserted into the fuel injection valve supporting hole 40 of the fuel distributing pipe D, the outer periphery 31C of the fuel pipe 31 on the rear edge surface 31A side of the fuel pipe 31 is come into contact with an entrance portion of the fuel injection valve supporting hole 40, so that there is a fear of occurrence of chips in the contacting portion. This is because a gap for insertion is formed between the outer periphery 31C of the fuel pipe 31 and the fuel injection valve supporting hole 40 and it is apprehended that the fuel pipe 31 is inclined in the gap and is inserted into the fuel injection valve supporting hole 40. This is also because the fuel pipe 31 is generally made of a metal material such as stainless steel or the like and the fuel distributing pipe D is made of a metal material such as aluminum, zinc alloy, or the like, so that both of those metal materials are come into contact with each other.

When the chips enter the elastic ring R arranged between the fuel pipe 31 and fuel injection valve supporting hole 40, the elastic ring R is damaged, so that it is unpreferable.

When the chips enter the filter net 38, the chips are accumulated in the filter net 38 and a filtering area of the filter net 38 is reduced, so that it is undesirable. Further, since the chips collide with the filter net 38 by an inertia force of the rapid fuel flow, there is a fear of damage of the filter net 38.

According to the second conventional example, the filter 41 is made of a synthetic resin material and an outer diameter of the annular flange portion 41A of the filter 41 is set to be larger than a diameter of the outer periphery 31C of the fuel pipe 31. Consequently, when the fuel pipe 31 is inserted into the fuel injection valve supporting hole 40 of the fuel distributing pipe D, the annular flange portion 41A of the synthetic resin material can be come into contact with the entrance portion of the fuel injection valve supporting hole 40, so that the generation of the chips in the contacting portion can be suppressed.

It is, however, difficult to accurately form the outer diameter portion of the annular flange portion 41A at the time of molding formation of the filter 41. It is considered that the reasons of it are because the diameter of the cylinder portion 41C and that of the annular flange portion 41A largely differ and there is a large difference between the areas in the cross sectional surfaces of the cylinder portion 41C and annular flange portion 41A, so that the outer diameter of the annular flange portion 41A is influenced by a deformation of the synthetic resin material at the time of formation.

When the annular flange portion 41A is formed so that its diameter is smaller than that of the outer periphery 31C of the fuel pipe 31, the outer periphery 31C of the fuel pipe 31 is come into contact with the fuel injection valve supporting hole 40, causing an inconvenience similar to that of the first conventional example. When the annular flange portion 41A is formed so as to have a large diameter, it is difficult to insert into the fuel injection valve supporting hole 40.

From the above points, it is necessary to accurately manage the diameter of the annular flange portion 41A, a large number of processing steps are needed for the managing work, and manufacturing costs rise, so that it is unpreferable.

SUMMARY OF THE INVENTION

The invention is made in consideration of the above inconveniences and it is a main object of the invention to extremely high accurately and cheaply manufacture a filter, by an injection molding, which is made of a synthetic resin material, in which when a fuel connector of a fuel injection valve is inserted into a fuel injection valve supporting hole of a fuel distributing pipe, the generation of chips in their contacting portion can be suppressed.

Another object of the invention is to obtain a filter with a high press-in toughness performance when the filter is inserted with a pressure into a fuel pipe of a fuel injection valve.

According to the invention, the above object is accomplished by a filter for a fuel injection valve, in which the filter made of a synthetic resin material is inserted into a fuel channel of one edge portion on the inserting side of a second fuel pipe that is inserted and connected into a first fuel pipe, thereby removing a foreign matter in a fuel, wherein in the first embodiment, the filter further comprises: an annular flange portion having an outer diameter larger than that of the first fuel pipe; a cylinder portion having an outer diameter smaller than an outer diameter of the annular flange portion, the cylinder portion having an opening portion provided in its outer peripheral portion so as to be communicated with a channel provided for the cylinder portion; a filter net provided for the opening portion; and an annular collar member which is made of a metal material and has an outer diameter larger than an inner diameter of the second fuel pipe.

The annular collar member is arranged in the outer peripheral portion of the cylinder portion and is molded integratedly with the annular flange portion and the cylinder portion so as to be buried into the annular flange portion.

Further, in the second embodiment of the invention, the annular collar member has a cylinder portion and a first annular portion extending outwardly in the radial direction from an edge portion of the cylinder portion on the annular flange portion side.

Further, in the third embodiment of the invention, a plurality of positioning concave grooves which face the channel are formed in the annular surface of the annular flange portion locating on the upstream side of the fuel channel and the concave grooves are formed so that a part of the annular collar member is exposed.

Further, in the fourth embodiment of the invention, the outer diameter of the cylinder portion is smaller than the inner diameter of the second fuel pipe.

Further, in the fifth embodiment of the invention, the first annular portion of the annular collar member is extended in its radial direction to an annular projection provided on the surface which faces the annular surface of the annular flange portion.

Further, in the sixth embodiment of the invention, the first annular portion of the annular collar member is arranged on the surface which faces the annular surface of the annular flange portion and is exposed.

Further, in the seventh embodiment of the invention, in addition to the sixth embodiment of the invention, the first annular portion of the annular collar member is extended in its radial direction to an annular projection provided on the surface which faces the annular surface of the annular flange portion.

According to the first embodiment of the invention, the annular collar member made of a metal material is arranged on the outer periphery of the collar member holding cylinder portion of the filter and is inserted and arranged in the annular flange portion and is molded integratedly with the filter in this state.

Since the annular collar member is inserted and arranged in the annular flange portion, when the filter is molded, a deformation in the radial direction of the annular flange portion is blocked by the annular collar member, so that an outer diameter of the annular flange portion can be accurately formed.

Since the annular collar member formed integratedly with the filter is inserted with a pressure into the fuel channel of the fuel pipe, the press-in toughness performance of the filter can be improved for a change in use environment.

Further, according to the second embodiment of the invention, with respect to the annular flange portion of the filter, since the annular collar member has a cylinder portion and a first annular portion extending outwardly in the radial direction from the edge portion of the cylinder portion on the annular flange portion side, the portion in which a deformation in the radial direction is blocked is enlarged by the annular collar member, so that the annular flange portion of the filter can be further accurately formed.

Further, according to the third embodiment of the invention, when the annular collar member is molded integratedly with the filter, as for the annular collar member, the outer peripheral surface of the cylinder portion and parts of the edge surface buried in the annular flange portion and the inside surface of the cylinder surface are fixed by a die and a core which are used for molding, so that the annular collar member is molded in this state.

Therefore, the annular collar member can be accurately and uniformly arranged and formed at a predetermined position for the filter.

Further, according to the fourth embodiment of the invention, the filter can be easily inserted into the fuel pipe with a pressure.

Further, according to the fifth embodiment of the invention, the effect obtained in the second embodiment of the invention becomes more remarkable.

Further, according to the sixth embodiment of the invention, under the actual use, even in the case where the annular projection of the annular flange portion which is come into contact with the fuel pipe is abraded, the first annular portion of the annular collar member made of the metal material is come into contact with the fuel pipe, thereby enabling the occurrence of an abrasion member and the progress of the abrasion to be prevented.

DETAILED DESCRIPTION OF THE PREFERRED EMBODIMENTS

Figure 1:
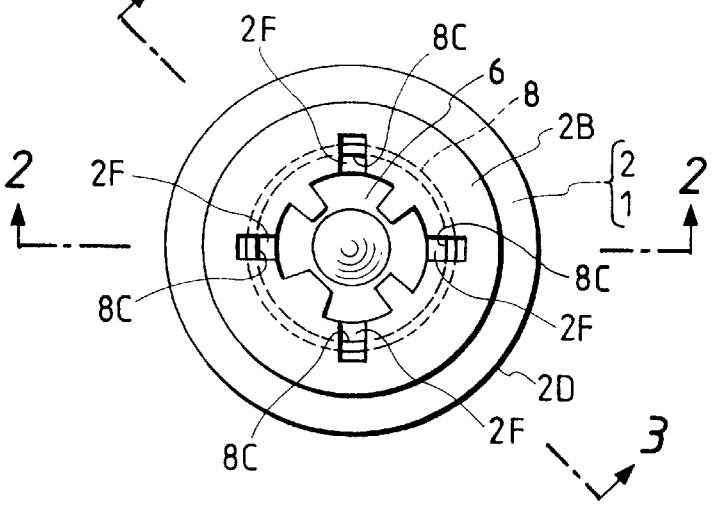
FIG. 1 is a plan view when a filter in the first embodiment of a filter in a fuel injection valve according to the invention is seen from a rear edge.
Figure 2:
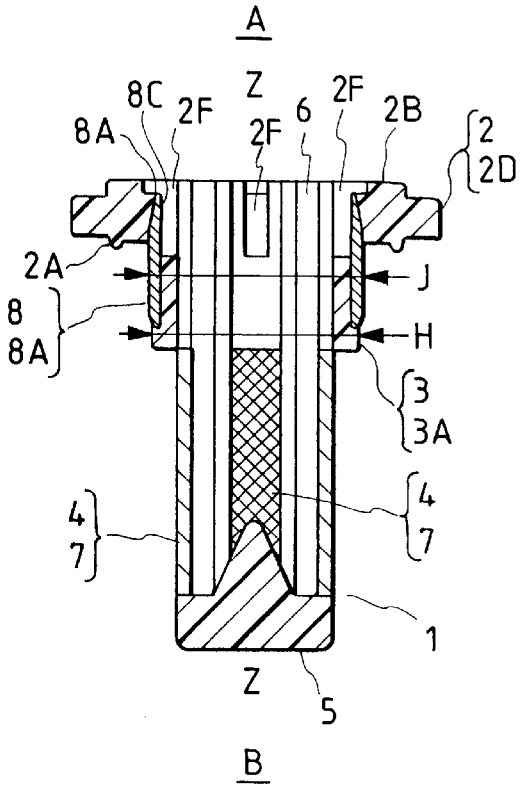
FIG. 2 is a vertical sectional view taken along the line 2—2 in FIG. 1.
Figure 3:
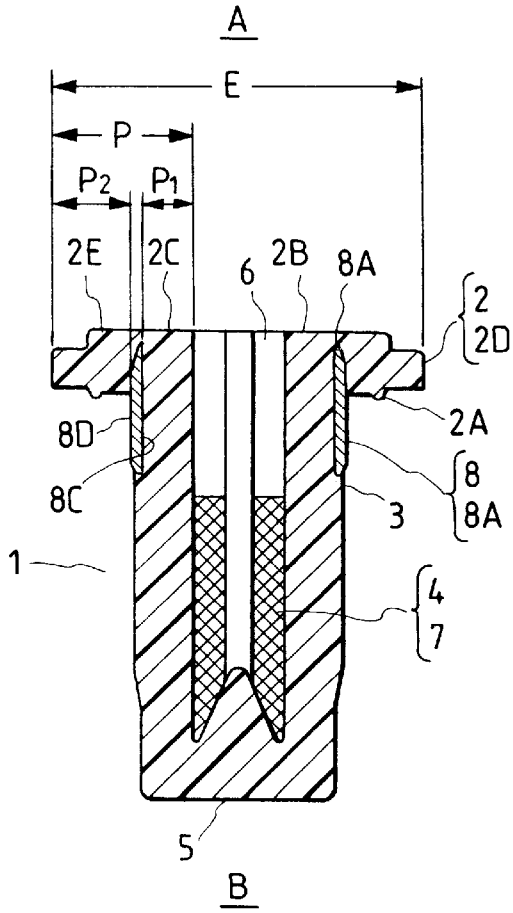
FIG. 3 is a vertical sectional view taken along the line 3—3 in FIG. 1.

The first embodiment of a filter in a fuel injection valve according to the invention will now be described hereinbelow. Portions having the same structures as those in the conventional ones are designated by the same reference numerals and their descriptions are omitted. FIG. 1 is a plan view of the filter when it is seen from a rear edge thereof. FIG. 2 is a vertical sectional view taken along the line 2—2 in FIG. 1. FIG. 3 is a vertical sectional view taken along the line 3—3 in FIG. 1.

A filter 1 is formed in a cylindrical shape by a synthetic resin material such as nylon or the like. An annular flange portion 2, a collar member holding cylinder portion 3, a slit groove 4, and a cylinder portion 5 with a bottom are serially formed in the filter 1 from a rear edge A side to a front edge B side thereof.

The annular flange portion 2 is located on the most rear edge A side and is formed in a thin plate disk shape. An outer diameter E of the annular flange portion 2 is smaller than an inner diameter F of the fuel injection valve supporting hole 40 of the fuel distributing pipe D and is larger than an outer diameter G of the fuel pipe 31.

The collar member holding cylinder 3 is directed from a front edge surface 2A of the annular flange portion 2 toward the front edge A side. The cylinder portion 5 with the bottom is formed in a front edge portion of the cylinder portion 3.

An outer diameter H of the collar member holding cylinder portion 3 is sufficiently smaller than the outer diameter E of the annular flange portion 2. The slit groove 4 is directed from the outer periphery of a relatively upper portion of the collar member holding cylinder portion 3 toward the outer periphery of the cylinder portion 5 with the bottom and is formed like a slit along a longitudinal axial direction Z—Z. In the embodiment, four slit grooves are formed at four positions at regular intervals in the circumferential direction of the collar member holding cylinder portion 3.

A channel 6 is formed from a rear edge surface 2B of the annular flange portion 2 toward the cylinder portion 5 with the bottom through the inside of the collar member holding cylinder portion 3. The channel 6 is opened so as to face the slit groove 4. The channel 6 is opened toward the outside through the slit groove 4.

Reference numeral 7 denotes a filter net which is made by a net and is attached over the slit groove 4.

Reference numeral 8 denotes an annular collar member made of a metal material. The annular collar member 8 in the embodiment has a cylindrical shape and its outer diameter J is larger than an inner diameter K of the fuel pipe 35 and is larger than the outer diameter H of the collar member holding cylinder portion 3.

When the filter 1 is molded by a synthetic resin material by using a die and a core, the annular collar member 8 is arranged at a position corresponding to the outer peripheral portion of the collar member holding cylinder portion 3 and is arranged at a position corresponding to a position where a rear edge surface 8A of the annular collar member 8 enters the annular flange portion 2.

The annular collar member 8 is positioned and arranged by the die and core as mentioned above. In this state, the synthetic resin material is injected into the die and the filter 1 in which the annular collar member 8 is integratedly molded is formed.

According to the molding of the filter 1, the annular collar member 8 is integratedly arranged around the outer periphery of the collar member holding cylinder portion 3. The rear edge surface 8A of the annular collar member 8 enters and is arranged in the annular flange portion 2.

Since the outer diameter J of the annular collar member 8 is set to be larger than the outer diameter H of the collar member holding cylinder portion 3, the outer peripheral portion 8B of the annular collar member 8 projects from the outer peripheral portion 3A of the collar member holding cylinder portion 3 in correspondence with a diameter between those diameters.

As mentioned above, the filter 1 integratedly equipped with the annular collar member 8 is assembled to the fuel injection valve N. That is, the filter 1 is inserted with a pressure into the fuel pipe 35 opening in the rear edge surface 31A of the fuel pipe 31.

According to the above structure, the collar member holding cylinder portion 3 having the cylinder portion 5 with the bottom, slit grooves 4, and annular collar member 8 is arranged in the fuel pipe 35 and the front edge surface 2A of the annular flange portion 2 is come into contact with the rear edge surface 31A of the fuel pipe 31. In this instance, since the outer diameter J of the annular collar member 8 is set to be larger than the inner diameter K of the fuel pipe 35 of the fuel pipe 31, the annular collar member 8 is certainly inserted into the fuel pipe 35 with a pressure and is fixed. When the filer 1 is molded, by setting the outer diameter H of the collar member holding cylinder portion 3 to be smaller than the inner diameter K of the fuel pipe 35, the press-in of the filter 1 into the fuel pipe 35 can be easily performed.

The fuel injection valve N into which the filter 1 has been inserted with a pressure is sandwiched between the fuel distributing pipe D and the intake pipe (not shown) through the elastic member C and is fixed.

That is, the annular flange portion 2 of the filter 1 and the fuel pipe 31 are inserted toward the inside of the fuel injection valve supporting hole 40 of the fuel distributing pipe D.

At this time, since the outer diameter E of the annular flange portion 2 is set to be smaller than the inner diameter F of the fuel injection valve supporting hole 40 and the outer diameter G of the fuel pipe 31 is set to be smaller than the outer diameter E of the annular flange portion 2, the fuel pipe 31 including the filter 1 is smoothly inserted into the fuel injection valve supporting hole 40 of the fuel distributing pipe D.

Figure 4:
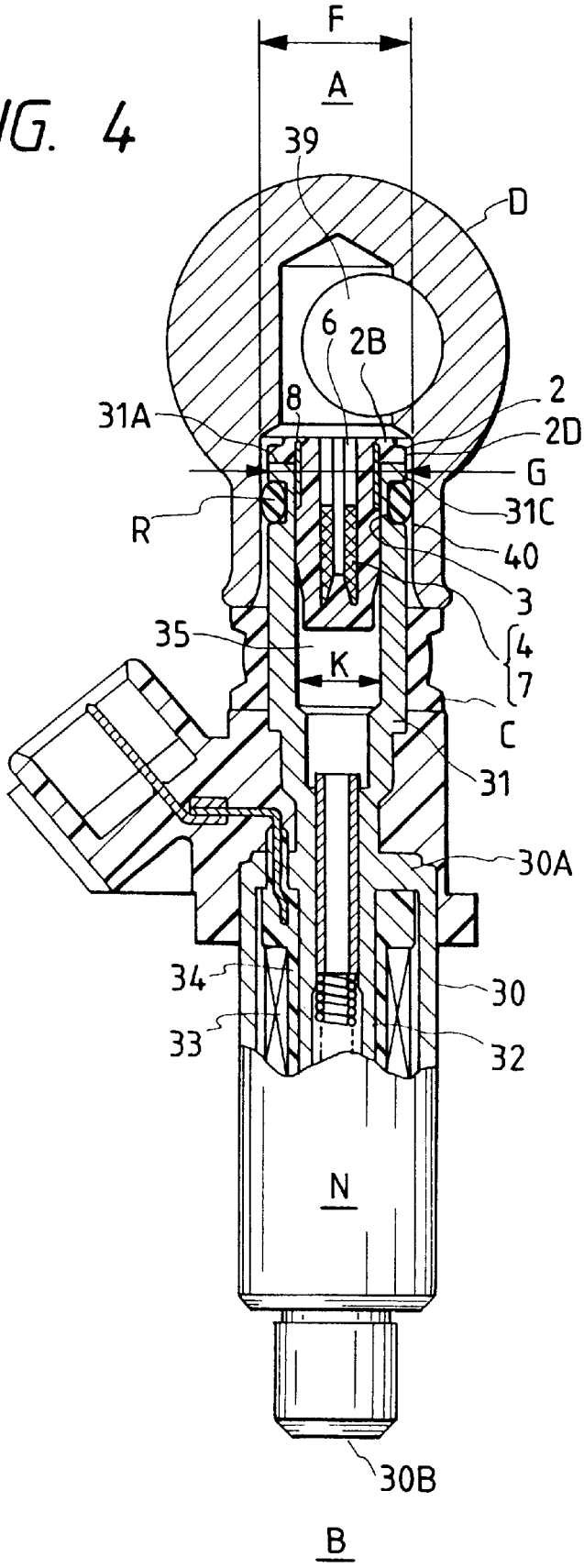
FIG. 4 is a vertical sectional view showing a state in which the filter according to the first embodiment is inserted into the fuel injection valve with a pressure and is attached to a fuel distributing pipe.

A gap formed between the outer periphery 31C of the fuel pipe 31 and the fuel injection valve supporting hole 40 of the fuel distributing pipe D is hermetically held by the elastic ring R. A state in which the fuel injection valve N having the filter 1 is attached to the fuel distributing pipe D is shown in FIG. 4.

When the fuel is supplied to the distributing passage 39 of the fuel distributing pipe D by a fuel pump (not shown), the fuel in the distributing passage 39 flows downstream toward the inside of the fuel pipe 35. When passing through the slit grooves 4 from the channel 6 of the filter 1, the fuel is filtered by the filter net 7. The clean fuel is supplied toward the valve hole in the fuel injection valve N.

According to the invention, the annular collar member 8 made of the metal material is arranged in an outer peripheral portion 3A of the collar member holding cylinder portion 3 of the filter 1 and is arranged in a manner such that the rear edge surface 8A of the annular collar member 8 enters the annular flange portion 2 and is directed toward the rear edge surface 2B side.

In the above state, when molding the filter 1 made of the synthetic resin material, the annular collar member 8 is molded integratedly with the filter 1.

Now, attention is paid to the annular flange portion 2 of the filter 1, in particular, it will be understood that in a cross sectional surface of the annular flange portion 2, the annular collar member 8 is arranged in almost the center portion of a whole width P of the annular flange portion 2 and the cross sectional surface of the annular flange portion 2 is cut out in the cross sectional direction by the annular collar member 8.

That is, when the filter 1 is molded, in the cross sectional surface of the annular flange portion 2, a first annular portion 2C with a width P1 is formed between an inside surface 8C of the annular collar member 8 and the channel 6 of the annular flange portion 2, and a second annular portion 2E with a width P2 is formed between an outside surface 8D of the annular collar member 8 and an outside surface 2D of the annular flange portion 2. In the cross sectional surface, the annular flange portion 2 is divided into the first annular portion 2C and the second annular portion 2E by the annular collar member 8.

When the filter 1 is molded, since the deformation in the radial direction of the first annular portion 2C of the annular flange portion 2 is shut off by the annular collar member 8 made of the metal material, no influence is exerted on the deformation in radial direction of the outside surface 2D of the annular flange portion 2.

On the other hand, although the deformation of the second annular portion 2E exerts an influence on the deformation in the radial direction of the outside surface 2D of the annular flange portion 2, the width P2 of the second annular portion 2E can be reduced by a length corresponding to the width P1 of the first annular portion 2C from the whole width P of the annular flange portion 2.

Since the width of the second annular portion 2E can be reduced as mentioned above and its volume can be decreased, when the filter 1 is molded, the deformation of the outer diameter E of the annular flange portion 2 can be suppressed as much as possible. The outer diameter E can be stably and uniformly formed at an extremely high precision.

As mentioned above, since the outer diameter E of the annular flange portion 2 of the filter 1 is set to be slightly larger than the outer diameter G of the fuel pipe 31 and the outer diameter E is formed at a high precision, when the fuel injection valve N having the filter 1 is inserted into the fuel injection valve supporting hole 40 of the fuel distributing pipe D, even if the fuel injection valve N is obliquely inserted into the supporting hole 40, the outside surface 2D of the annular flange portion 2 of the filter 1 is first come into contact with the fuel injection valve supporting hole 40. Thus, the contact between the metal portions can be avoided and the generation of chips in the contacting portion can be consequently suppressed.

Since the dimensional precision of the outer diameter E of the annular flange portion 2 of the filter 1 can be stably and uniformly set at an extremely high precision, the number of managing processing steps of the outer diameter E of the annular portion 2 can be remarkably reduced and, in particular, the decrease in manufacturing costs of the filter 1 can be accomplished.

Even if a coarse fuel containing alcohol, moisture, and the like is used under environmental conditions such as a severe temperature and the like and the supply of the fuel is stopped after that or even when the filter 1 is held in a dry state at the time of a decomposition of the fuel injection valve or the like, the outer diameter J of the annular collar member 8 made of the metal material is never changed, and the annular collar member 8 is certainly inserted with a pressure into the fuel pipe 35 of the fuel pipe 31 and is held. Therefore, the press-in toughness of the filter 1 to the fuel pipe 31 can be stably and preferably maintained for a long time.

An insertion height of the rear edge surface 8A of the annular collar member 8 into the annular flange portion 2 is properly selected in dependence on a shape of annular flange portion 2, the synthetic resin material which is used, or the like.

A point that a positioning concave groove 2F is formed on the rear edge surface 2B of the annular flange portion 2 of the filter 1 will now be described with reference to FIGS. 1 and 2.

The positioning concave groove 2F is formed on the rear edge surface 2B of the annular flange portion 2 and a plurality of positioning concave grooves are formed at a plurality of positions (in the embodiment, four positions at an interval of 90°) in the circumferential direction of the rear edge surface 2B and are also opened so as to face the channel 6. Parts of the rear edge surface 8A of the annular collar member 8 and of the inside surface 8C on the rear edge A side are opened to the positioning concave grooves 2F.

With the above structure, when the filter 1 is injection molded, in case of integratedly molding the annular collar member 8 to the filter 1, parts of the rear edge surface 8A of the annular collar member 8 and the inside surface 8C of the rear edge A side are arranged in contact with the core (not shown) as a die to form the positioning concave grooves 2F and channel 6. The outer peripheral portion 8D of the annular collar member 8 is fixedly arranged in contact with the die (not shown) forming the external shape portions such as annular flange portion 2 of the filter 1, collar member holding cylinder portion 3, and the like. In such a state, the filter is injection molded.

According to the above structure, at the time of the injection molding, even if the melted synthetic resin material collides with the annular collar member 8 in a cavity of the die, the annular collar member 8 is certainly fixedly arranged and is not moved. Therefore, the annular collar member 8 can be extremely accurately arranged at a predetermined position in the filter 1. Particularly, a coaxial state between the annular collar member 8 and the annular flange portion 2 can be accurately maintained, so that a coaxial state between the annular flange portion 2 of the filter 1 and the outer periphery 31C of the fuel pipe 31 can be accurately maintained. Thus, the outside surface 2D of the annular flange portion 2 of the filter 1 is set into a coaxial state for the outer periphery 31C of the fuel pipe 31 and can be arranged so as to be accurately outwardly projected.

Figure 5:
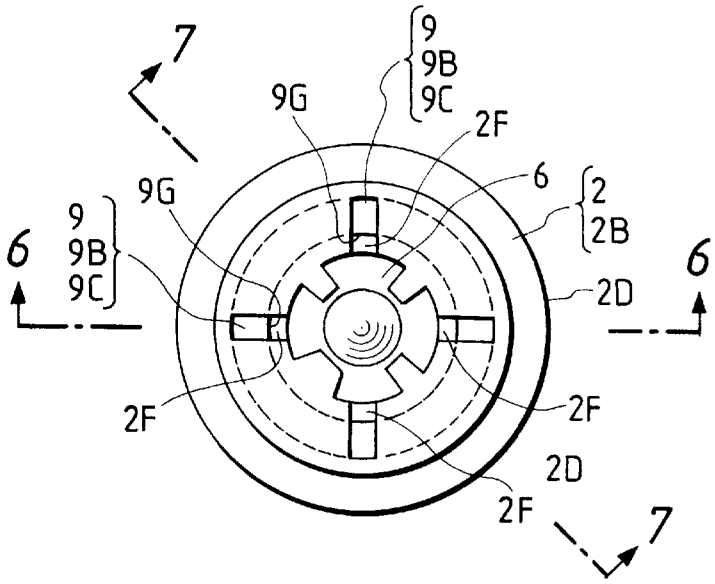
FIG. 5 is a plan view when a filter according to the second embodiment of the filter in the fuel injection valve of the invention is seen from a rear edge.
Figure 6:
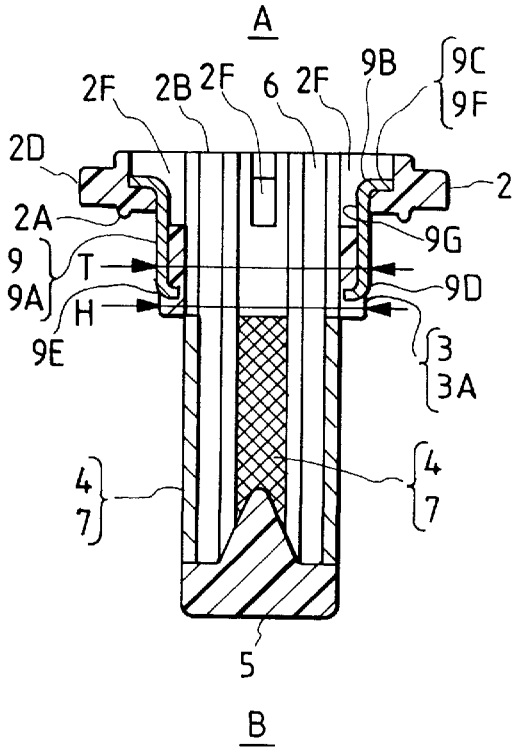
FIG. 6 is a vertical sectional view taken along the line 6—6 in FIG. 5.
Figure 7:
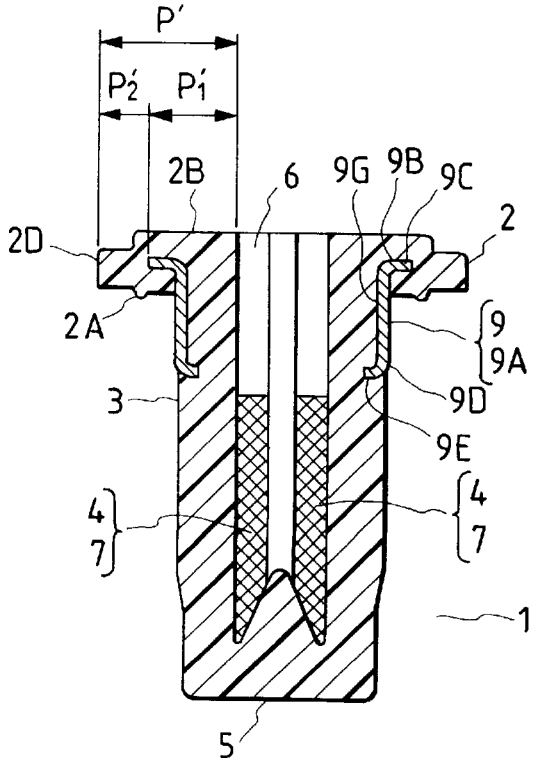
FIG. 7 is a vertical sectional view taken along the line 7—7 in FIG. 5.

The second embodiment of a filter will now be described with reference to FIGS. 5, 6, and 7. FIG. 5 is a plan view of the filter when it is seen from a rear edge. FIG. 6 is a vertical sectional view taken along the line 6—6 in FIG. 5. FIG. 7 is a vertical sectional view taken along the line 7—7 in FIG. 5.

An annular collar member differs from that in the first embodiment and portions having the same structures as those in the first embodiment are designated by the same reference numerals and only different portions will be described.

Reference numeral 9 denotes an annular collar member made of a metal material. Reference numeral 9A denotes a cylindrical cylinder portion. An outer diameter T of the cylinder portion 9A is larger than the outer diameter H of the collar member holding cylinder portion 3 of the filter 1 and is larger than the inner diameter K of the fuel pipe 35 of the fuel pipe 31. A first annular portion 9C is bent and formed from a rear edge 9B of the cylinder portion 9A toward the outer circumferential direction. A second annular portion 9E is bent and formed from a front edge 9D of the cylinder portion 9A toward the inner circumferential direction.

The annular collar member 9 is formed integratedly with the filter 1 at the time of molding of the filter 1 in a manner similar to the first embodiment.

That is, the cylinder portion 9A of the annular collar member 9 is arranged in the outer peripheral portion 3A of the collar member holding cylinder portion 3. The first annular portion 9C including the rear edge 9B enters and is arranged in the annular flange portion 2. The second annular portion 9E including the front edge 9D is arranged in the collar member holding cylinder portion 3.

According to the filter 1 of the second embodiment, although a precision of the outer diameter E of the annular flange portion 2 can be improved in a manner similar to the first embodiment, the following effects can be further obtained on the basis of a difference of the structure from the annular collar member 8 in the first embodiment.

Generally, as for the injection molding of the filter, a gate for injection is provided at the center of the cylinder portion 5 with the bottom and the melted synthetic resin material is injected into the cavity of the die through the gate.

When considering an inflow of the synthetic resin material into the annular flange portion 2 of the filter 1, the synthetic resin material flows so as to be directed to the outside surface 2D of the annular flange portion 2 along the first annular portion 9C directing toward the outside of the circumference of the annular collar member 9.

With the above structure, particularly, the flow of the synthetic resin material in the annular flange portion 2 at a rear flow edge for the gate is smoothed, the precision of the outer diameter E of the annular flange portion 2 can be further improved, and the filter can be uniformly formed.

In the annular flange portion 2, since the first annular portion 9C of the annular collar member 9 is arranged along the cross sectional surface of the annular flange portion 2, the deformation in the horizontal direction of the annular flange portion 2 is suppressed, so that a flat surface of the front edge surface 2A of the annular flange portion 2 can be further accurately formed.

With the above structure, when the front edge surface 2A of the annular flange portion 2 is come into contact with the rear edge surface 31A of the fuel pipe 31, an inclination of the outside surface 2D of the annular flange portion 2 doesn't occur and the outside surface 2 of the annular flange portion 2 can be certainly arranged outwardly from the outer periphery 31C of the fuel pipe 31.

Further, by extending an outer line of the first annular portion 9C including the rear edge 9B up to the front edge surface 2A of the annular flange portion 2 in the radial direction, the deformation in the horizontal direction of the annular flange portion 2 is further suppressed and a flatness degree of the front edge surface 2A can be improved. Consequently, an adhesion performance in the case where the front edge surface 2A of the annular flange portion 2 is come into contact with the rear edge surface 31A of the fuel pipe 31 is improved and a sealing function is improved. At the same time, a looseness of the filer 1 for the fuel pipe 35 can be also certainly prevented by the stable contact.

Since the annular collar member 9 has the first annular portion 9C and second annular portion 9D which extend in the opposite directions at both ends of the annular collar member 9, a pressure tightness in the radial direction can be further raised as compared with that of the annular portions extending in the same direction. Particularly, a plate thickness of the annular collar member 9 can be made thin. A degree of freedom of the arrangement of the annular collar member 9 into the filter 1 can be raised.

It is desirable to form the positioning concave groove 2F onto the rear edge surface 2B of the annular flange portion 2 of the filter 1 in a manner similar to the filter of the first embodiment.

A plurality of positioning concave grooves 2F are formed in the circumferential direction of the rear edge surface 2B and are opened so as to face the channel 6. Parts of the annular collar member 9, a rear edge surface 9F (surface on the rear edge A side of the first annular portion 9C), and an inside surface 9G on the rear edge A side are opened to the positioning concave grooves 2F.

With the above structure, upon injection molding of the filter 1, when the annular collar member 9 is integratedly molded to the filter 1, parts of the rear edge surface 9F of the annular collar member 9 and the inside surface 9G on the rear edge surface A side are arranged in contact with the core (not shown) as a die to form the positioning concave grooves 2F and channel 6. On the other hand, an outer peripheral portion of the annular collar member 9 is fixedly arranged in contact with the die (not shown) to form external shape portions such as annular flange portion 2 of the filter 1, collar member holding cylinder portion 3, and the like. In such a state, the filter is injection molded.

With the above structure, a coaxial state between the annular collar member 9 and the annular flange portion 2 can be accurately maintained in a manner similar to the first conventional filter. Thus, a coaxial state between the annular flange portion 2 of the filter 1 and the outer periphery 31C of the fuel pipe 31 can be accurately maintained. Therefore, the outside surface 2D of the annular flange portion 2 of the filter 1 is set into a coaxial state for the outer periphery 31C of the fuel pipe 31 and can be accurately arranged so as to be projected outwardly.

Figure 8:
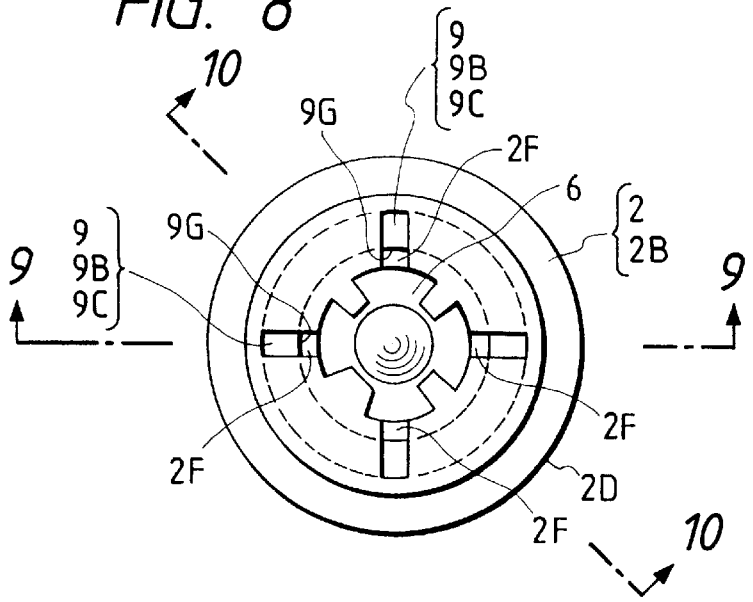
FIG. 8 is a plan view of a filter according to the third embodiment of the filter in the fuel injection valve in the invention is seen from a rear edge.
Figure 9:
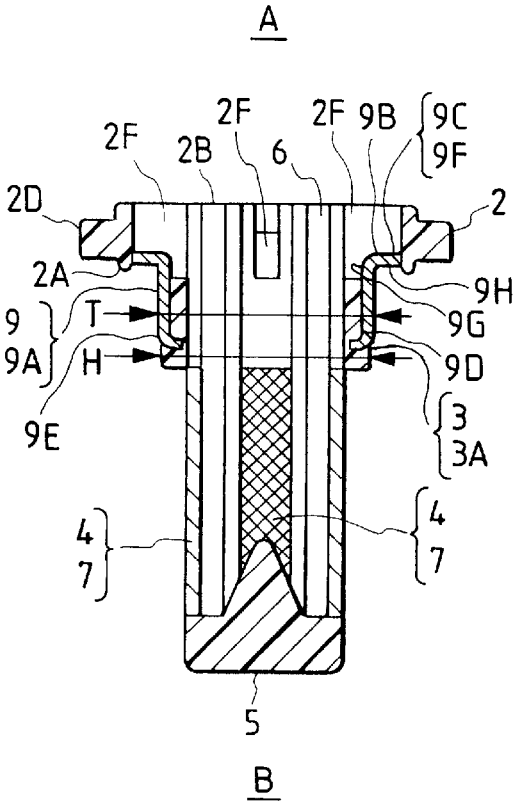
FIG. 9 is a vertical sectional view taken along the line 9—9 in FIG. 8.
Figure 10:
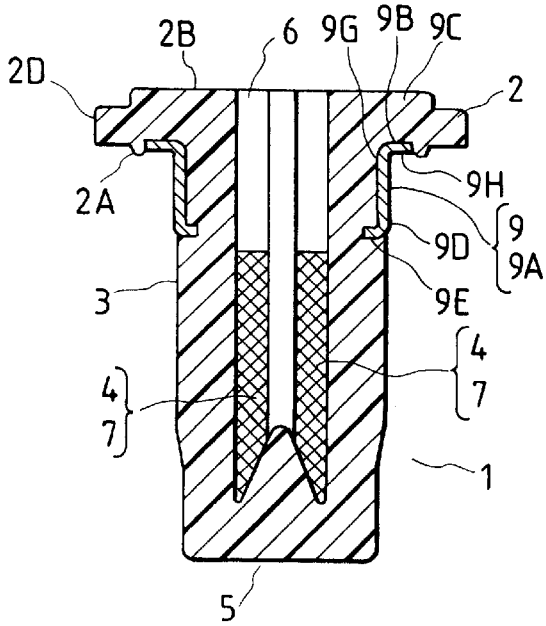
FIG. 10 is a vertical sectional view taken along the line 10—10 in FIG. 8.
Figure 11:
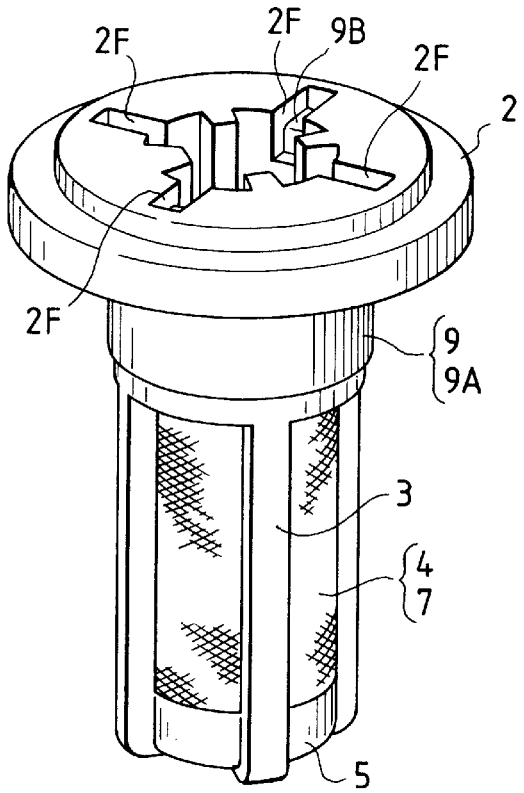
FIG. 11 is a perspective view of the filter in FIG. 8 when it is seen from the upper direction thereof.
Figure 12:
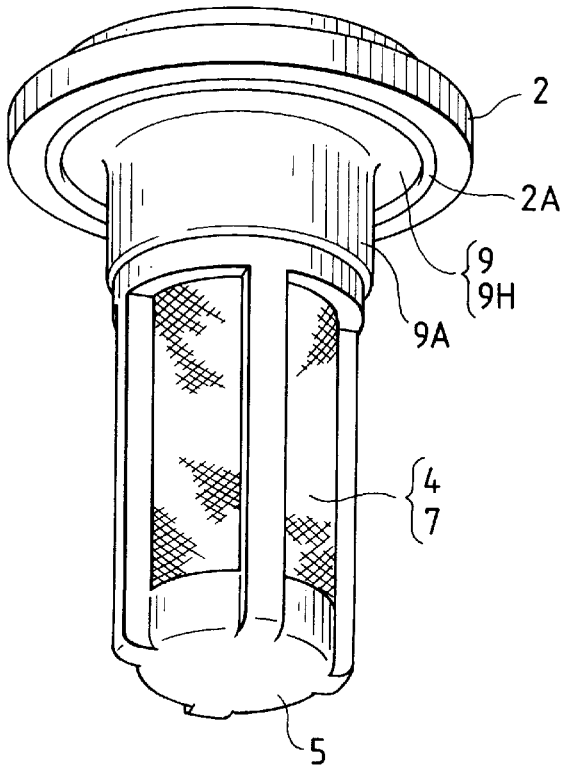
FIG. 12 is a perspective view of the filter in FIG. 8 when it is seen from the lower direction thereof.
Figure 13:
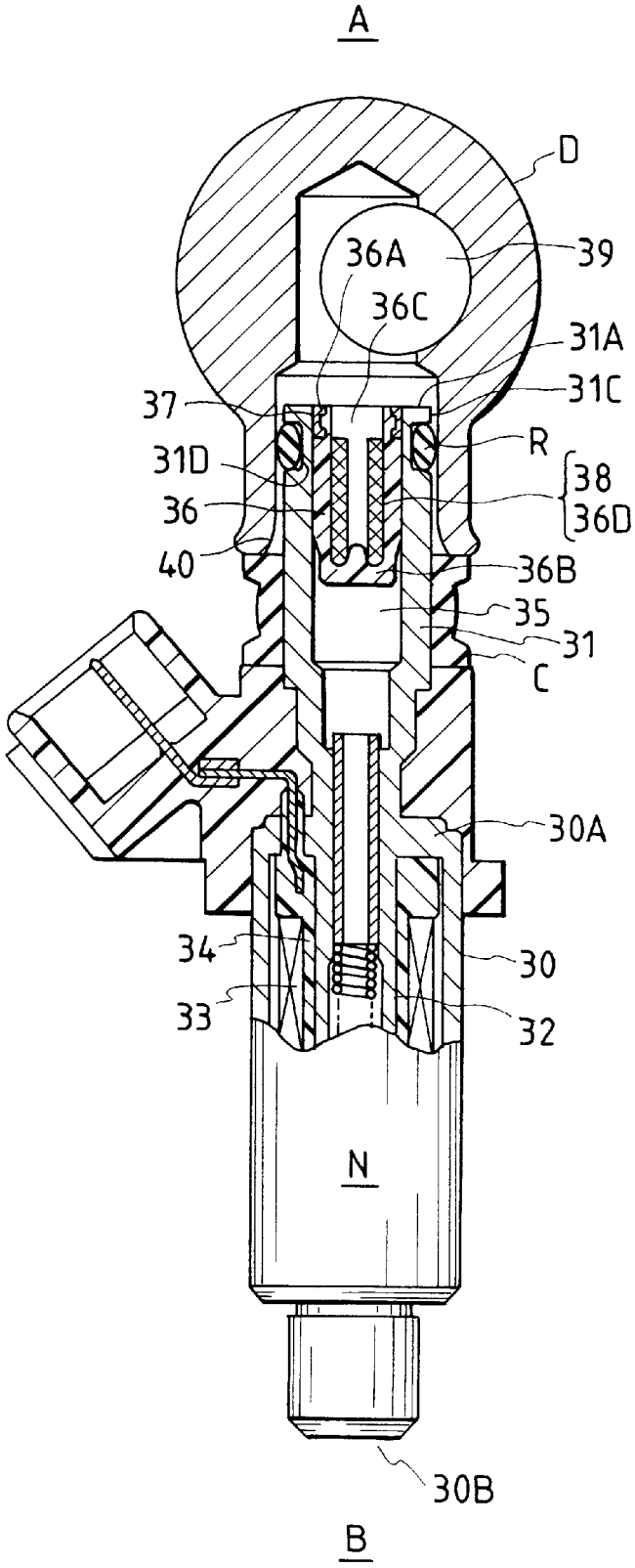
FIG. 13 is a vertical sectional view showing the first example of a filter in a conventional fuel injection valve.
Figure 14:
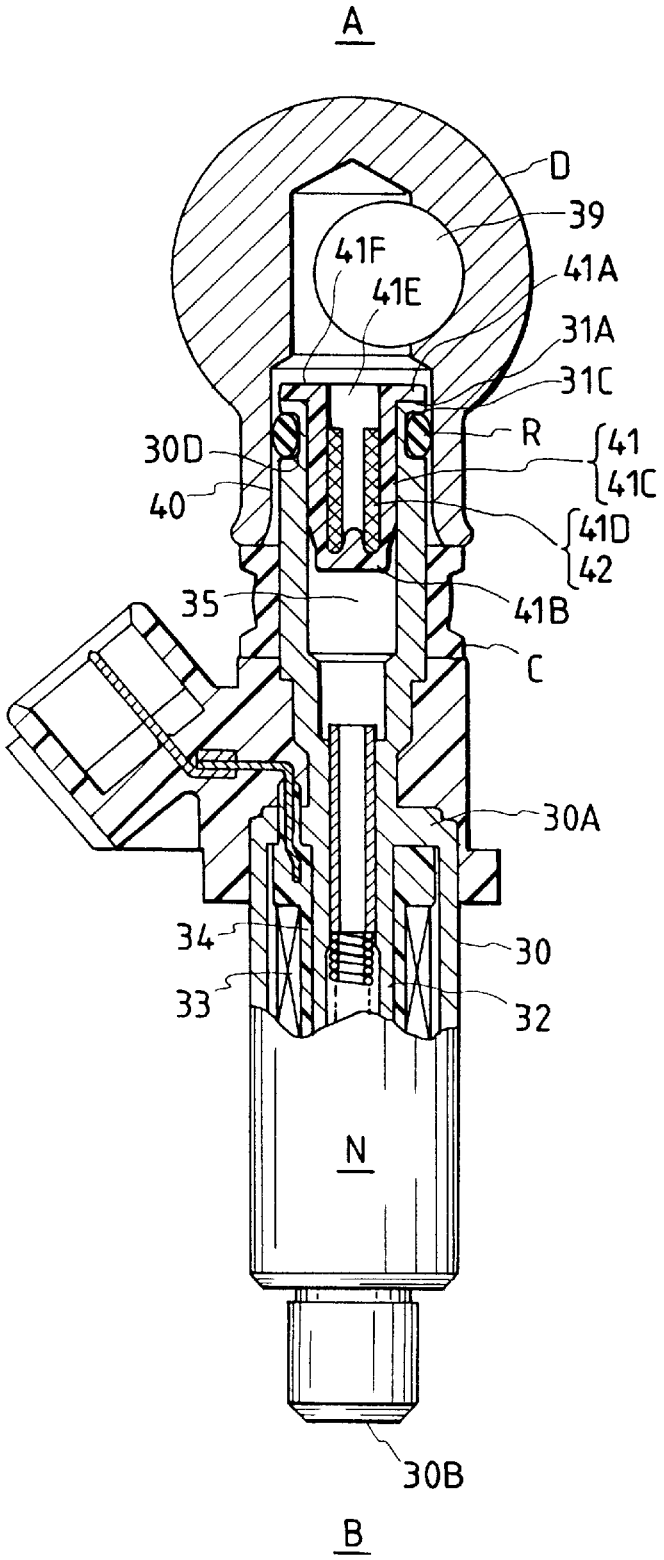
FIG. 14 is a vertical sectional view showing the second example of a filter in the conventional fuel injection valve.

The third embodiment of a filter will now be described with reference to FIGS. 8, 9, and 10. FIG. 8 is a plan view of the filter when it is seen from a rear edge hereof. FIG. 9 is a vertical sectional view taken along the line 9—9 in FIG. 8. FIG. 10 is a vertical sectional view taken along the line 10—10 in FIG. 8.

In the third embodiment, a fixing arrangement of the annular collar member 9 when the annular collar member 9 is integratedly molded in the filter 1 is different from that of the second embodiment. Portions having the same structures as those in the second embodiment are designated by the same reference numerals and only different portions will be described.

In the third embodiment, on the side where the projected front edge surface 2A of the annular flange portion 2 is provided, a front edge surface 9H (surface on the side opposite to the rear edge A side of the first annular portion 9C) of the first annular portion 9C of the annular collar member 9 is provided so as to be exposed inwardly in the radial direction than the front edge surface 2A. Even in the embodiment as well, the effects mentioned in association with the second embodiment can be obtained and the following effects can be also derived.

For example, even if a situation such that a bending deformation of the annular flange portion 2 is caused by a pulsating motion of the high pressure fuel and the front edge surface 2A is abraded occurs, the front edge surface 9H made of a metal is come into contact with the rear edge surface 31A of the fuel pipe 31, so that a further progress of the abrasion can be prevented. Thus, a damage of the annular flange portion 2 due to the generation of a large quantity of abrasion chips and the progress of the abrasion can be prevented.

Further, by extending the exposed front edge surface 9H of the first annular portion 9C so as to approach the front edge surface 2A, the above effect can be improved.

According to the filter in the fuel injection valve of the invention, the filter is made of the synthetic resin material, the annular flange portion, collar member holding cylinder portion, and cylinder portion with the bottom are serially formed from the rear edge toward the front edge of the filter, and the slit grooves equipped with the filter net are formed from the channel formed inwardly toward the outer periphery of the collar member holding cylinder portion. On the other hand, the outer diameter of the annular collar member made of the metal material is slightly larger than the inner diameter of the second fuel pipe and is slightly larger than the outer diameter of the collar member holding cylinder portion. The annular collar member is arranged on the outer periphery of the collar member holding cylinder portion and is inserted into the annular flange portion and is molded integratedly with the filter. Therefore, the deformation of the outer diameter of the annular flange portion can be suppressed as much as possible. The outer diameter of the annular flange portion of the filter can be stably and uniformly formed at an extremely high precision. Thus, the generation of the chips when the fuel injection valve is inserted into the fuel injection valve supporting hole of the fuel distributing pipe can be suppressed.

The number of managing steps of the annular flange portion of the filter can be remarkably reduced and the reduction of the manufacturing costs can be accomplished.

Further, the press-in toughness performance of the filter for the first fuel pipe can be stably and preferably maintained for a long time.

Since the annular collar member is formed by the cylinder portion, the first annular portion extending from the rear edge of the cylinder portion in the outer circumferential direction, and the second annular portion extending from the front edge of the cylinder portion in the inner circumferential direction, the outer diameter of the annular flange portion can be uniformly formed at a further accurate precision. The flat surface of the front edge surface of the annular flange portion can be formed further precisely. Moreover, the annular collar member can be made thin and a degree of freedom of the arrangement into the filter can be raised.

A plurality of positioning concave grooves which face the channel are opened to the rear edge surface of the annular flange portion of the filter and parts of the rear edge surface of the annular collar member and the inside surface on the rear edge side are arranged so as to be opened to the positioning concave grooves. Therefore, the coaxial state between the annular flange portion of the filter and the outer periphery of the first fuel pipe can be accurately maintained. The outside surface of the annular flange portion can be accurately arranged coaxially with the outer periphery of the first fuel pipe so as to be outwardly projected.

What is claimed is:

1. A filter in a fuel channel, in which said filter is made of a synthetic resin material and is inserted into said fuel channel of one edge portion on said inserting side of a second fuel pipe that is inserted and connected into a first fuel pipe, thereby removing a foreign matter in a fuel, comprising:

an annular flange portion having an outer diameter larger than an outer diameter of said second fuel pipe;

a cylinder portion having an outer diameter smaller than the outer diameter of said annular flange portion, said cylinder portion having an opening portion provided in an outer peripheral portion so as to be communicated with a channel provided in said cylinder portion;

a filter net provided for said opening portion; and an annular collar member to be tightly connected to a said second fuel pipe, wherein said annular collar member is arranged in said outer peripheral portion of said cylinder portion and is molded integratedly with said annular flange portion and said cylinder portion so as to be buried into said annular flange portion.

2. A filter according to claim 1, wherein said annular collar member has a cylinder portion and a first annular portion extending outwardly in a radial direction from an edge portion of said cylinder portion on said annular flange portion side.

3. A filter according to claim 1, wherein a plurality of positioning concave grooves which face said channel are formed on an annular surface of said annular flange portion locating on the upstream side of said fuel channel, and said concave grooves are formed so that a part of said annular collar member is exposed.

4. A filter according to claim 1, wherein the outer diameter of said cylinder portion is smaller than the inner diameter of said second fuel pipe.

5. A filter according to claim 2, wherein said first annular portion of said annular collar member extends in its radial direction to an annular projection provided on a surface which faces an annular surface of said annular flange portion.

6. A filter according to claim 2, wherein said first annular portion of said annular collar member is arranged and exposed to a surface which faces an annular surface of said annular flange portion.

7. A filter according to claim 6, wherein said first annular portion of said annular collar member extends in its radial direction to an annular projection provided on the surface which faces the annular surface of said annular flange portion.

8. A filter according to claim 2, wherein a plurality of positioning concave grooves which face said channel are formed on an annular surface of said annular flange portion locating on the upstream side of said fuel channel, and said concave grooves are formed so that a part of an edge surface on the upstream side of said fuel channel of said first annular portion of said annular collar member and a part of an inner surface of said annular collar member cylinder portion which continues are exposed.

9. A filter according to claim 2, wherein the outer diameter of said cylinder portion is smaller than the inner diameter of said second fuel pipe.

10. A filter according to claim 1, wherein said annular collar member is made of a metal material and has an outer diameter slightly larger than an inner diameter of said second fuel pipe.

* * * * *